US005831490A

United States Patent [19]

Särkkä et al.

[11] Patent Number: 5,831,490

[45] Date of Patent: Nov. 3, 1998

[54] METHOD AND APPARATUS FOR TUNING A BASE STATION SUMMING NETWORK HAVING AT LEAST TWO TRANSMITTER BRANCHES

[75] Inventors: Veli-Matti Särkkä , Oulunsalo; Timo Ahonpää , Oulu, both of Finland

[73] Assignee: Nokia Telecommunications Oy, Espoo, Finland

[21] Appl. No.: 809,065

[22] PCT Filed: Jun. 26, 1996

[86] PCT No.: PCT/FI96/00370

§ 371 Date: Mar. 3, 1997

§ 102(e) Date: Mar. 3, 1997

[87] PCT Pub. No.: WO97/02616

PCT Pub. Date: Jan. 23, 1997

[30] Foreign Application Priority Data

Jul. 3, 1995 [FI] Finland ..... 953292

[51] Int. Cl.[6] ..... H01P 5/12; H01P 1/18; H01P 7/10

[52] U.S. Cl. ..... 333/126; 333/134; 333/202; 333/235

[58] Field of Search ..... 333/32, 33, 35, 333/126, 129, 132, 134, 202, 235, 230, 219.1

[56] References Cited

U.S. PATENT DOCUMENTS

| | | | |
|---|---|---|---|
| 2,408,745 | 10/1946 | Espley | 333/35 |
| 2,463,415 | 3/1949 | Nims, Jr. | 333/263 |
| 2,637,782 | 5/1953 | Magnuski | 333/132 |
| 2,900,610 | 8/1959 | Allen et al. | 333/35 |
| 4,375,622 | 3/1983 | Hollingsworth et al. | 333/126 |
| 4,497,030 | 1/1985 | Bowling et al. | 364/481 |
| 4,667,172 | 5/1987 | Longshore et al. | 333/134 |
| 4,755,778 | 7/1988 | Chapell | 333/160 X |
| 5,315,274 | 5/1994 | Sarkka | 333/219.1 |
| 5,440,281 | 8/1995 | Wey et al. | 333/126 |
| 5,545,959 | 8/1996 | Bacher | 333/34 X |
| 5,625,330 | 4/1997 | Wilson et al. | 333/230 |

FOREIGN PATENT DOCUMENTS

| | | | |
|---|---|---|---|
| 0492304 | 7/1992 | European Pat. Off. | 333/235 |
| 92/20116 | 11/1992 | WIPO . | |

OTHER PUBLICATIONS

Kuchler, Ceramic Resonators for Highly Stable Oscillators, Siemens Components XXIV (1989) No. 5, pp. 180–183.

Fiedziuszko, Microwave Dielectric Resonators, Microwave Journal, Sep. 1986, pp. 189–198.

Pospieszalski, Cylindrical Dielectric and Their . . . Microwave Circuits, IEEE Transactions on Microwave Theory and Techniques, vol. MTT–27, No. 3, Mar. 1979.

*Primary Examiner*—Seunhgsook Ham
*Attorney, Agent, or Firm*—IP Gourp of Pillsbury Madison & Sutro LLP

[57] ABSTRACT

A base station summing network having at least two transmitter branches made turnable by providing filters in the branches with adjusters, so that each branch can be separately adjusted.

7 Claims, 5 Drawing Sheets

METHOD AND APPARATUS FOR TUNING A BASE STATION SUMMING NETWORK HAVING AT LEAST TWO TRANSMITTER BRANCHES

BACKGROUND OF THE INVENTION

This application is the national phase of international application PCT/F196/00370 filed Jun. 26 1996 which designated the U.S.

The invention relates to a method for tuning a summing network of a base station. The invention also relates to a connecting means and a band-pass filter.

The invention particularly relates to a summing network of combiner filters of a base station in a cellular radio system. A combiner filter is a narrowband band-pass filter which is in resonance (tuned) precisely at the frequency of the carrier wave of the transmitter connected to it. The adjustment range of band-pass filters is usually 2 to 10% of the center frequency. The signals obtained from the outputs of the combiners are added together by a summing network and fed to the antenna of the base station. A summing network usually comprises a coaxial cable leading to the antenna of the base station, combiner filters being connected to the cable via connecting means and T-branches. In order that a maximum portion of the transmission power of the transmitters would be transferred to the antenna, the summing network must be tuned with respect to the frequency channels used by the transmitters of the base station. In fact, the summing network is tuned only on one frequency, but with movement away from the optimal frequency, the mismatching does not increase very abruptly at first. In the base stations of a cellular radio system, a summing network can thus usually be used at a frequency band the breadth of which is about 1 to 3% of the center frequency of the frequency band.

The tuning of known summing networks is based on the use of transmission lines having an accurate length in proportion to the wavelength. This sets high requirements for cabling of a summing network, since the transmission lines must be of exactly the right length so that the summing network will be optimized to the correct frequency. As automatically (by remote control) adjustable combiner filters have become more general, a need has arisen to find a way of changing the tuning of a summing network in a simple and quick manner. The useful frequency band of a summing network is too narrow to allow major changes in the frequency channels of the transmitters of a base station without that the tuning of the summing network has to be changed. The previously known solution, in which a mechanic goes to the location of a base station and replaces the cabling of a summing network with cabling designed for a new frequency band, is obviously too expensive and time-consuming.

SUMMARY OF THE INVENTION

The object of the present invention is to provide a solution to the above problem. The object is achieved by the method, connecting means and band-pass filter provided by the invention.

The term 'generally tubular' here refers to a conductor that has been shaped as a tube and may have apertures, e.g. one or more slits lengthwise of the tube, on its sleeve surface. The tubular conductor may also be at least partly conic.

The invention is based on the idea that by adjusting, in a fixed summing network, the reflection coefficient of the connecting means by which the cabling of the summing network is connected to a filter belonging to the summing network, it is possible to compensate in the summing network for the wavelength error generated at different center frequencies, the error causing a phase angle error between the waves advancing and reflecting in the summing network. In other words, by adjusting the reflection coefficient of the connecting means to accomplish a phase shift, the combined electrical length of the filter and the summing cable connected to the summing point of the summing network can be maintained correct ($n\times\lambda/4$), whereby the reflecting and the advancing wave are in phase, as seen from the summing point.

With regard to the tuning of a summing network, it is essential that the output port of the filter can be adjusted. With regard to summing, the adjustment of the input port of the filter is not as important. Yet the use of a similar adjustable connecting means at the input port as at the output port may in some cases help the other parameters of the filter (e.g. forward attenuation, band width and group propagation time) to remain constant In the invention, the adjustment of the phase angle of a reflecting wave is based on an air-dielectric coaxial structure, in which there is a moveable part at least around the center conductor, the moveable part being made of low-loss dielectric material, such as ceramics or polytetrafluoroethylene, or of ferrimagnetic material. When the moveable part is moved lengthwise of the center conductor, it affects the field prevailing in the connecting means so that the phase angle of the reflecting wave can be adjusted.

When an RF signal is supplied to a connecting means of the invention from a first end of the conductor parts, the signal supplied is reflected from a capacitive connecting probe or inductive loop formed by the conductor parts at a second end of the connecting means, whereby a standing wave is generated in the arrangement. In the standing wave, the energy distribution of the electric and magnetic field changes as a function of place with movement along the coaxial structure, so that the maximum of the magnetic field and the minimum of the electric field are reached at the second end of the connecting means (e.g. at the short-circuit point of the inductive loop). Towards the opposite end of the connecting means, the energy distribution of the fields changes so that the energy in the electric field reaches the maximum and the magnetic field reaches the minimum a quarter of a wavelength before the maximum of the magnetic field.

On account of the above-described energy distribution, the effect of the moveable part on the phase angle of the reflecting wave is determined by the location of the moveable part, i.e. as a function of place. If the relative permittivity of the moveable part $\epsilon r>1$ (and at the same time its relative permeability $\mu r=1$), then the effect of the moveable part on the coefficient of reflection is at its greatest at the maximum point of the electric field and at its smallest at the maximum point of the magnetic field. If $\epsilon r=1$ and $\mu r>1$ in the material, then the effect is reverse, i.e. the maximum effect is reached at the maximum of the magnetic field.

The primary advantage of the solution provided by the invention is thus that the tuning frequency of the summing network can be changed in a very simple manner, e.g. by remote control, and so it is not necessary for a mechanic to go and change the cabling of the summing network as the frequency channel changes. The connecting means provided by the invention allows simple and linear adjustment of the reflection coefficient of the connecting means. The sharpness and reflection coefficient of the control characteristic can also be easily affected by design and choice of material of the moveable part.

In a preferred embodiment of the connecting means provided by the invention, the connecting means is surrounded by a tubular metal sleeve that is connected to ground potential. The metal sleeve intensifies the effect of the adjustment of the reflection coefficient. In a preferred embodiment of the band-pass filter provided by the invention, the means for adjusting the resonance frequency of the resonator and the means for adjusting the reflection coefficient of the connecting means are connected to a common actuator. This solution makes it possible for the system operator to reset both the frequency band of the band-pass filter and the reflection coefficient of the connecting means of the band-pass filter to a new optimum value at one go, using remote control.

BRIEF DESCRIPTION OF THE DRAWINGS

In the following, the invention will be described in greater detail by way of an example with reference to the attached drawings, in which.

DETAILED DESCRIPTION

Figure 1:
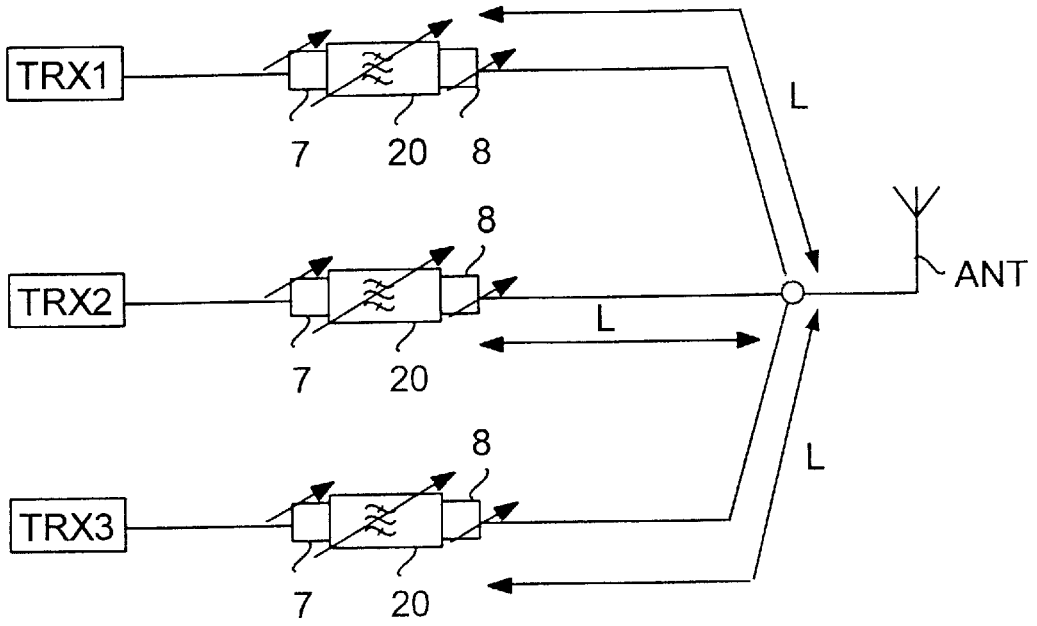
FIG. 1 is a block diagram of a summing network of a base station.

FIG. 1 is a block diagram of a summing network of a base station in which the method of the invention can be applied. The summing network shown in FIG. 1 may be e.g., a summing network of a base station of the GSM system, by which three transceiver units TRX1–TRX3 are connected to a common transmission antenna ANT. Band-pass filters 20 shown in FIG. 1 are filters known per se, their pass band being adjustable, preferably by remote control, from the control room of the network. The structure, operation and ceramic manufacturing materials of the adjustable dielectric resonators are presented e.g., in the following publications, which are incorporated in the present application by reference:

[1] 'Ceramic Resonators for Highly Stable Oscillators,' Gundolf Kuchler, *Siemens Components XXXIV* (1989), No. 5, p. 180–183,

[2] 'Microwave Dielectric Resonators,' S. Jerry Fiedziuszko, *Microwave Journal,* September 1986, p. 189 onwards,

[3] 'Cylindrical Dielectric Resonators and Their Applications in TEM Line Microwave Circuits,' Marian W. Pospieszalski, *IEEE Transactions on Microwave Theory and Techniques* Vol. MTT-27, No. 3, March 1979, p. 233–238,

[4] Finnish Patent 88,227, 'Dielectric resonator.'

In FIG. 1, each transceiver unit TRX1–TRX3 is connected to a first connecting means 7, i.e. input port, of the corresponding adjustable band-pass filter 20. Correspondingly, second connecting means 8, i.e. output ports, of the band-pass filters 20 are connected by transmission cables of equal length l to a summing point P, at which the signals from different transmitters are added together before they are supplied to an antenna ANT. The output port, i.e. second connecting means 8, of each filter 20 adjusts in accordance with the center frequency and always maintains the combined electrical length of the filter and the summing cable that has been connected to the summing point P correct ($n^*\lambda/4$), i.e. seen from the summing point P, the reflecting wave and the advancing wave are in phase. Preferably, the output ports 8 automatically adjust to a new optimum value while the pass band of the band-pass filter 20 is adjusted by remote control.

In FIG. 1, the input ports, i.e. the first connecting means 7, are also adjustable. This, however, is not essential to the summing.

Figure 2A:
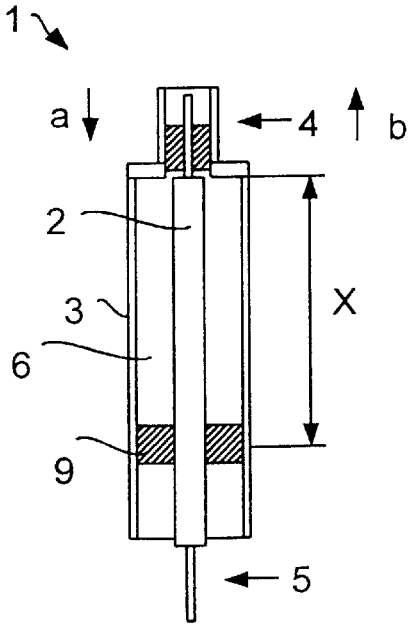
FIG. 2*a* shows a first preferred embodiment of a connecting means according to the invention.

FIG. 2*a* shows a first preferred embodiment of a connecting means provided by the invention. FIG. 2*a* shows a coaxial connecting means 1 comprising an elongated rod-shaped center conductor 2 surrounded by an generally tubular conductor 3.

A first end 4 of the connecting means is arranged to receive a twin wire, here a coaxial cable, whereby the inner conductor of the coaxial cable is connected to the center conductor 2 while the outer conductor of the coaxial cable is connected to the tubular conductor 3.

The center conductor 2 is longer than the tubular conductor 3, whereby it projects from the tubular conductor 3 at a second end 5 of the connecting means, forming a capacitive probe there. The thickness of the center conductor 2 may be constant at its entire length, although in the example of FIG. 2*a* its thickness varies.

A moveable part 9 made of low-loss dielectric material is arranged in an annular air-filled space 6 between the center conductor 2 and the tubular conductor 3, the part being moveable (vertically in FIG. 2*a*) in the space 6. The low-loss dielectric material here means material whose relative permittivity $\epsilon r>1$ (and thereby relative permeability $\mu r=1$), for example Teflon or ceramics.

In FIG. 2*a,* the advancing wave $a/\alpha°$ is indicated by arrow a and the reflecting wave $b/\beta°$ by arrow b. The reflection coefficient T is then:

$$T = \frac{a}{b} \underline{/\alpha^o - \beta^o}$$

Figure 2B:
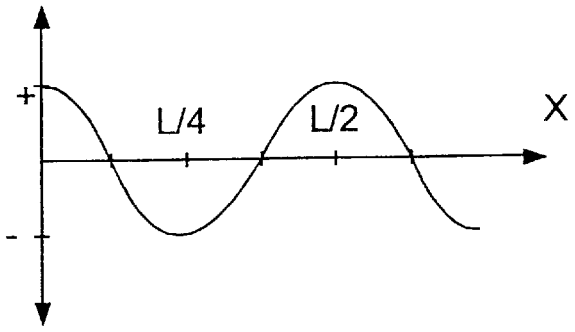
FIG. 2*b* illustrates the properties of the connecting means shown in FIG. 2*a,*

The moving of the moveable part 9 from one point to another influences the reflection coefficient of the connecting means 1 in the manner shown in FIG. 2*b*. A slit is provided in the generally tubular outer conductor (not shown in the figure) lengthwise of the tube, the moveable part 9 being moveable through the slit in the tubular conductor 3. The structure presented in FIG. 2*a* thus allows simple and sufficiently linear phase angle adjustment of a reflecting wave, the axial adjustment movement being easy to combine with the frequency adjustment movement of the filter. In addition, the slope and sharpness of the control characteristic of the adjusting means can be easily affected by the design and choice of material of the moveable part.

FIG. 2*b* illustrates the characteristics of the connecting means shown in FIG. 2*a*. FIG. 2*b* shows the relative change T in the phase angle of the reflection coefficient as a function of distance x, when the electrical length of the structure is 3L/4.

Figure 3A:
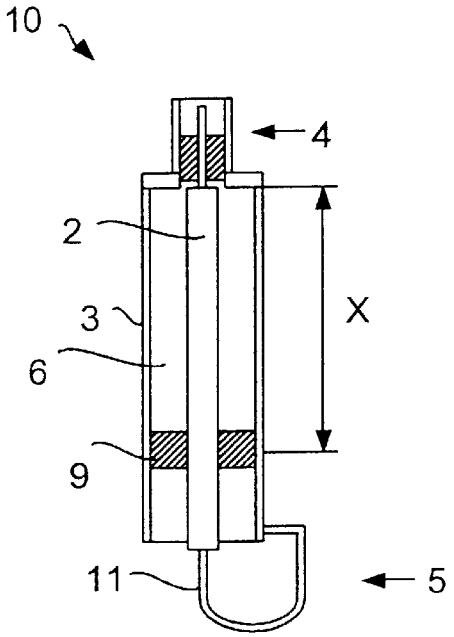
FIG. 3*a* shows a second preferred embodiment of a connecting means according to the invention.

FIG. 3*a* illustrates a second preferred embodiment of a connecting means provided by the invention. A connecting means 10 shown in FIG. 3*a* corresponds to the connecting means 1 of FIG. 2*a* with respect to the structure, with the exception that the center conductor 2 at the lower end 5 of connecting means 10 is connected to a tubular conductor 3 by a conductive loop section 11 so as to form an inductive connecting loop.

In the standing wave generated in connecting means 10, the energy distribution of the electric and magnetic field changes as a function of place as one advances along the coaxial structure, so that the maximum of the magnetic field and thereby the minimum of the electric field are reached at the short-circuit point of the inductive loop. With movement away from the short-circuit point, the energy distribution in the fields changes so that the energy of the electric field reaches its maximum and the magnetic field reaches its minimum a quarter of a wavelength away from the short-circuit point.

Figure 3B:
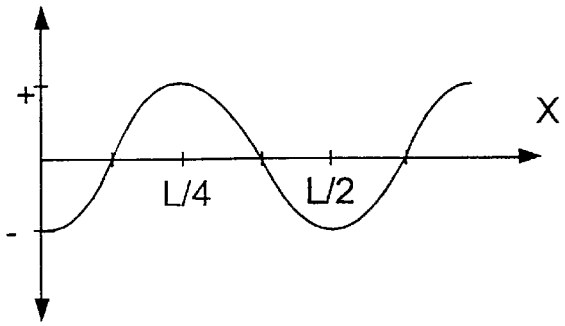
FIG. 3*b* illustrates the properties of the connecting means shown in FIG. 3*a,*

FIG. 3*b* illustrates the properties of the connecting means 10 shown in FIG. 3*a*. FIG. 3*b* shows the relative change of the phase angle of the reflection coefficient T as a function of distance x, when the electrical length of the structure is 3L/4.

Figure 4:
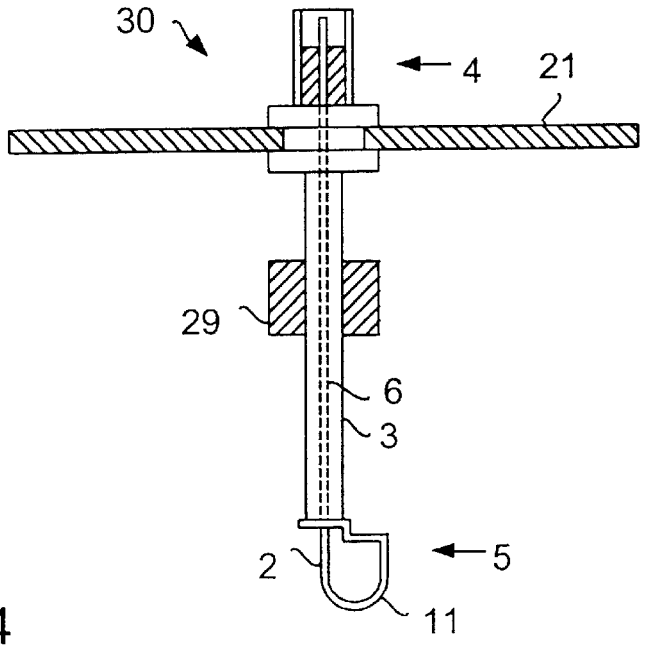
FIG. 4 shows a third preferred embodiment of a connecting means according to the invention.

FIG. 4 shows a third preferred embodiment of a connecting means provided by the invention. A connecting means 30 shown in FIG. 4 comprises a center conductor 2 surrounded by a tubular conductor 3. The upper end 4 of the connecting means, which will remain outside a metal casing 21 of the filter, is formed so as to receive a twin wire, i.e. here a coaxial cable.

The center conductor 2 is connected to the tubular conductor with a loop section 11 at the lower end 5 of the connecting means so as to form an inductive loop. The embodiment of FIG. 4 differs from the earlier described embodiments in that a moveable part 29 is arranged outside the tubular conductor, whereby it surrounds both the center conductor 2 and the tubular conductor 3. In the annular space 6 between the center conductor 2 and the tubular conductor 3 there may thus be air. The annular space, however, is worth filling e.g. with isolating material conventionally used in cables, the isolating material supporting the center conductor 2 in the tubular conductor 3.

Figure 5:
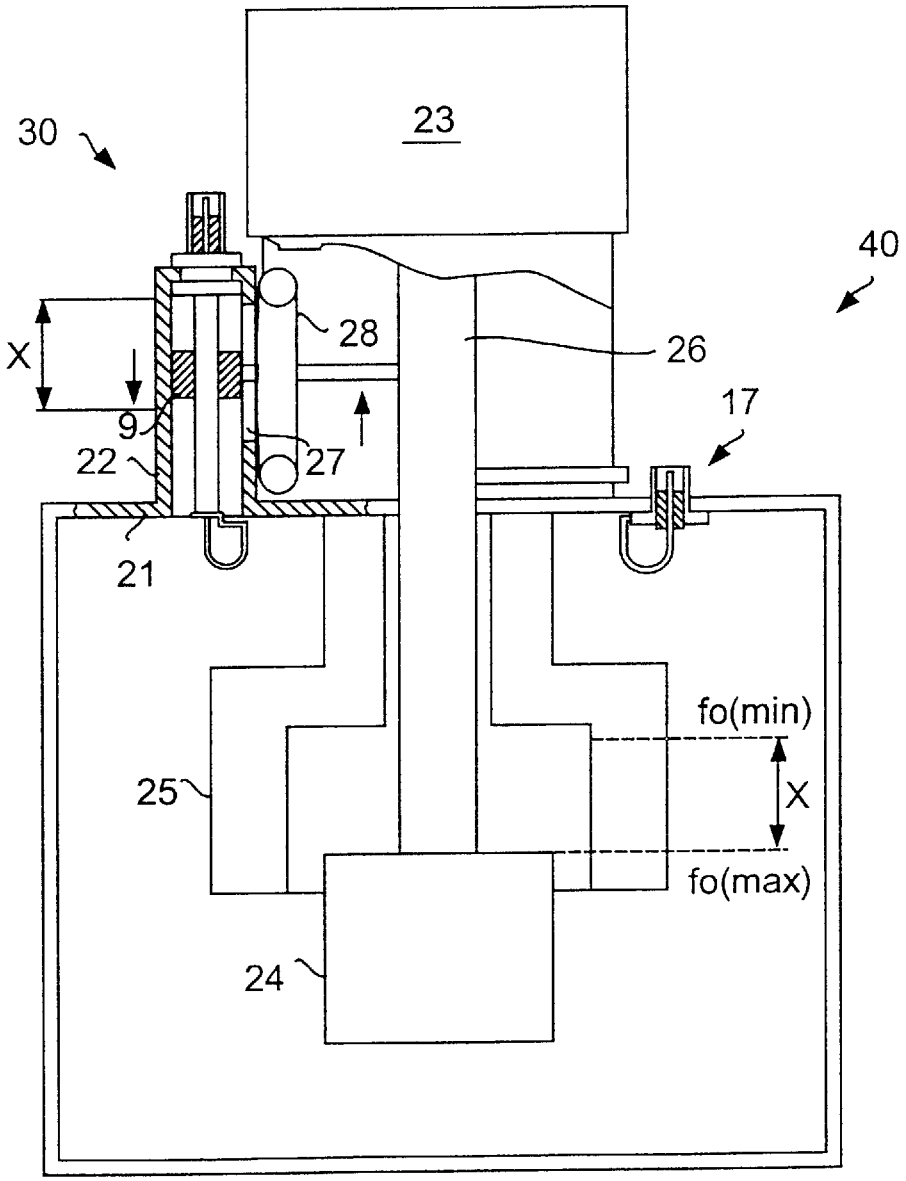
FIG. 5 shows a first preferred embodiment of a band-pass filter according to the invention.

FIG. 5 shows a first preferred embodiment of a band-pass filter 40 provided by the invention. FIG. 5 shows a band-pass filter, known per se, that can be used, e.g. at a base station of a cellular radio system, the band-pass filter comprising a resonator that consists of two blocks 24 and 25 made of dielectric material, such as ceramics.

The band-pass filter 40 is adjustable, whereby the operator can adjust the resonance frequency of the resonator by remote control so that it corresponds to the center frequency of the frequency band of the transmitter unit connected thereto. To achieve this, the filter 40 comprises an actuator 23 that can move a moveable dielectric block 24 by means of an arm 26 in relation to a dielectric block 25 fixedly attached to the casing 21 of the filter 40. The position of the dielectric blocks 24 and 25 in relation to each other, in turn, determines the resonance frequency of the resonator, the frequency in FIG. 5 varying e.g., between 1805 and 1880 MHz. In FIG. 5, the adjustment is performed by moving the lower dielectric block 24 in the vertical direction, the adjustment margin being indicated by X is FIG. 5. The adjustment margin X in FIG. 5 may be e.g. 20 mm.

The output connection of the band-pass filter 40, i.e. connecting means 30, through which the filter is connected to a summing network of a base station and further to an antenna, is adjustable. The input connection of the band-pass filter, through which the band-pass filter is connected to the transmission unit, in turn, comprises a conventional, non-adjustable connecting means 17.

Connecting means 30 consists of the adjustable connecting means shown in FIG. 4. To enhance the adjustment of the phase angle of a wave reflecting from connecting means 30, the connecting means is arranged in a tubular metal sleeve 22, which is connected to ground potential. In FIG. 5, the metal sleeve 22 comprises the cover portion of sleeve 21.

At one edge of the metal sleeve 22, there is a vertical notch 27, through which there extends an arm needed for moving the moveable part 9, one end of the arm being attached to a belt 28. The belt 28, in turn, is connected to a vertical arm 26 with another arm. As the actuator 23 adjusts the resonance frequency of the resonator by means of arm 26, the phase angle of a wave reflecting from connecting means 30 is thereby adjusted so that the reflecting wave and the advancing wave are in phase at the summing point of a summing network of a base station. As shown in FIG. 5, the moveable part 9 and the lower dielectric block 24 move in opposite directions during the adjustment on account of the belt mechanism.

The summing network is thus tuned automatically to a new frequency due to the adjustable connecting means 30. In other words, the structure of the filter 40 allows simple and sufficiently linear phase angle adjustment of the reflecting wave, the axial adjustment movement being easy to combine with the frequency adjustment movement of the filter. In addition, experiments have shown that with a band-pass filter of FIG. 5, the characteristics that are important to the filter, i.e. insertion attenuation, port return attenuation and unloaded Q-value, are maintained practically constant when the above-described connecting means is used.

Figure 6A:
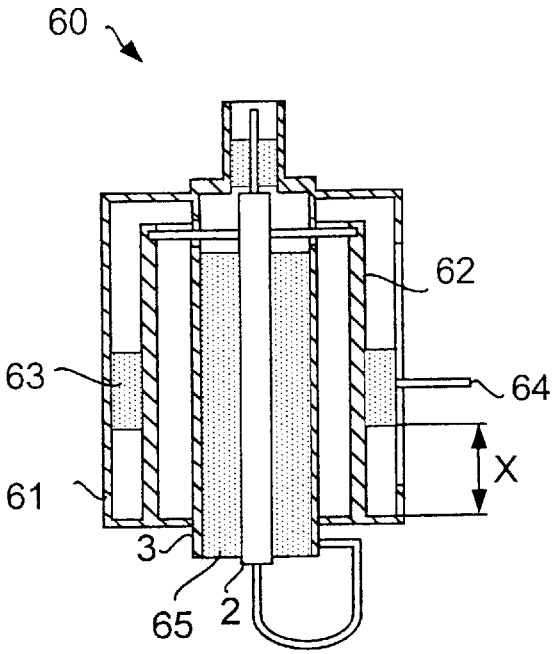
FIG. 6*a* shows a fourth preferred embodiment of a connecting means according to the invention.

FIG. 6*a* illustrates a fourth preferred embodiment of a connecting means provided by the invention. A connecting means 60 shown in FIG. 6*a* is similar to the connecting means of FIG. 3*a,* which has an inductive loop. The connecting means 60 of FIG. 6*a,* however, comprises two tubular metal sleeves 61 and 62 around the connecting means, and a moveable block 63 is arranged between the metal sleeves. Alternatively, the moveable block can be arranged, for example, in the space between sleeve 62 and the tubular conductor 3.

In FIG. 6*a,* the annular space between the center conductor 2 and the tubular conductor 3 is filled with supporting material 65, which locks the center conductor 2 in respect of the tubular conductor 3. Such suitable supporting material 65 is, for example, some isolating material conventionally used in cables. Alternatively, the annular space can be left empty, if the position of the center conductor 2 in relation to the tubular conductor 3 can be ensured in some other way.

FIG. 6*a* also shows an arm 64 with which moveable part 63 is moved. It should be noted here that when moveable part 9 and block 24 of the resonator are moved in FIG. 5 in the opposite directions during the adjustment, moveable part 64 of connecting means 60 must be moved in the same direction as block 24 of the resonator, if the connecting means of FIG. 6*a* is used in the resonator of FIG. 5. The belt mechanism of FIG. 5 thus becomes unnecessary and the structure is simplified.

Figure 6B:
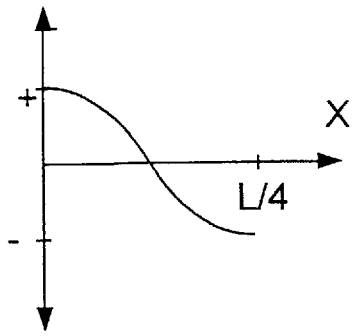
FIG. 6*b* illustrates the properties of the connecting means shown in FIG. 6*a,*

FIG. 6*b* illustrates the properties of the connecting means GO presented in FIG. 6*a*. FIG. 6*b* shows the relative change of the phase angle of the reflection coefficient T as a function of distance x, when the electrical length of the structure is L/4 and the length of the connecting means is n*L/2.

Figure 7:
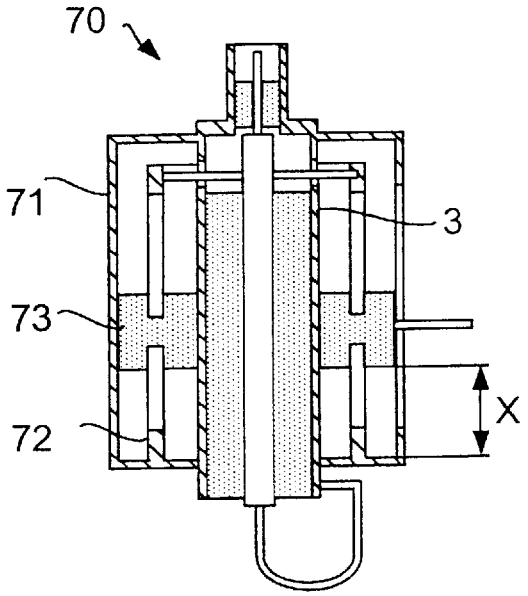
FIG. 7 shows a fifth preferred embodiment of a connecting means according to the invention.

FIG. 7 shows a fifth preferred embodiment of the connecting means provided by the invention. A connecting means 70 of FIG. 7 corresponds to the connecting means of FIG. 6*a* except that a two-part moveable block 73 is used therein. A first annular part of the moveable block 73 is arranged between metal sleeves 71 and 72, and a second annular part is arranged between the inner metal sleeve 72 and the tubular conductor 3. The two annular parts are connected to each other through slits arranged in the metal sleeve 72, as shown in FIG. 7.

Figure 8A:
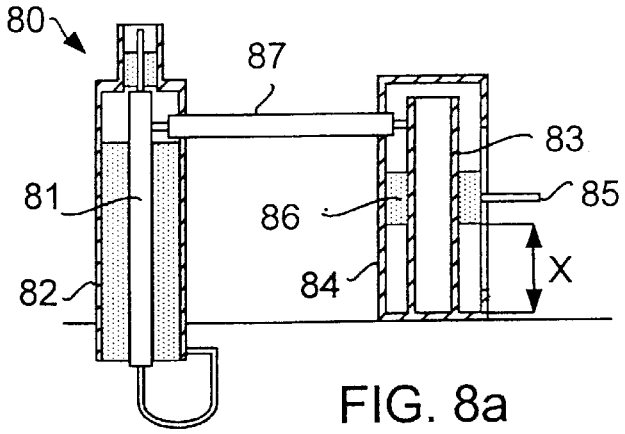
FIG. 8*a* shows a sixth preferred embodiment of a connecting means according to the invention.

FIG. 8*a* shows a sixth preferred embodiment of the connecting means provided by the invention. In FIG. 8, a connecting means 80 comprises two parts, whereby the parts of the connecting means can be spaced apart from each other. In the first part of the connecting means, there is thus a first center conductor 81; an inductive loop (or alternatively a capacitive probe) and a first tubular conductor 82 projecting therefrom. Supporting material is provided between the center conductor 81 and the tubular conductor.

The second part of the connecting means comprises a second rod-shaped center conductor 83, which in the situation illustrated by FIG. 8 is hollow, a second tubular conductor 84, and a moveable part 86 arranged in the annular space between them; the moveable part being moved by an arm 85. The second part of the connecting means 80 can be arranged outside the casing of the resonator in its entirety. The two parts of the connecting means are connected with a coaxial cable 87, the center conductor of which interconnects center conductors 81 and 83 and the outer conductor of which interconnects tubular conductors 82 and 84.

The parallel adjustment arrangement shown in FIG. 8*a* intensifies the adjustment effect caused by the movement of the moveable part.

Figure 8B:
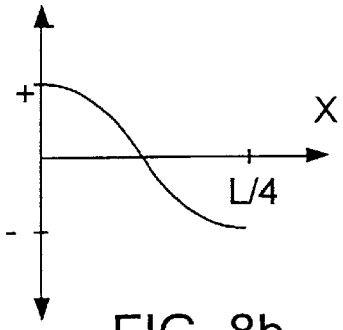
FIG. 8*b* illustrates the properties of the connecting means shown in FIG. 8*a,* and FIG. 9 shows a second preferred embodiment of a band-pass filter according to the invention.

FIG. 8*b* illustrates the properties of the connecting means 80 shown in FIG. 8*a*. FIG. 8*b* presents the relative change of the phase angle of the reflection coefficient T as a function of distance x, when the electrical length of the arrangement is L/4 and the length of the connecting means is n*L/4.

Figure 9:
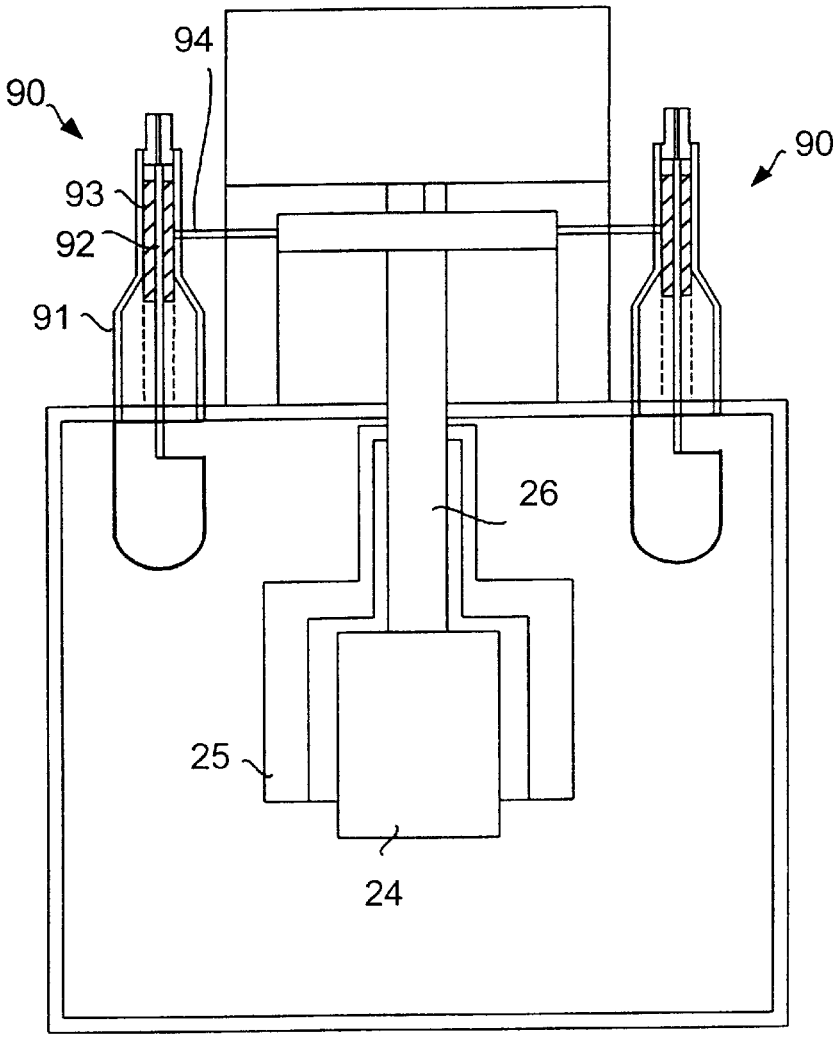

FIG. 9 shows a second preferred embodiment of a band-pass filter provided by the invention. The band-pass filter of FIG. 9 corresponds to the band-pass filter shown in FIG. 5 except that a connecting means 90 contained therein differs with respect to the structure.

In the band-pass filter of FIG. 9, adjustable connecting means 90 is used both in the input connection and in the output connection. Connecting means 90 correspond to the connecting means shown in FIG. 3*a* except that, as shown in FIG. 9, their tubular conductor 91 is partly conic so that the diameter is greater at the lower end than at the upper end. When a dielectric moveable block 93 in the annular space between a center conductor 92 and a tubular conductor 91 is moved down (in FIG. 9), the effective dielectric constant of the dielectric material in the coaxial structure is reduced. Due to this, the velocity factor of the cable grows, whereby the electrical length of the coaxial structure is reduced. The adjustment effect is thus intensified by the fact that the tubular conductor 91 is at least partly conic.

When the connecting means of FIG. 9 is used, no belt mechanism shown in FIG. 5 is needed. This results from the fact that when the dielectric block 24 of the resonator is moved in relation to the fixed dielectric block 25 to adjust the resonance frequency of the resonator, the moving block 93 of the connecting means 90 must be moved in the same direction in order to be able to tune the summing network to a new frequency. An arm 94 used for moving the moveable block 93 can be directly attached to arm 26, with which dielectric block 24 of the resonator is moved.

The above description and the accompanying drawings are to be understood as only illustrating the present invention. It will be obvious to a person skilled in the art that the invention can be varied and modified in many ways without deviating from the scope and spirit of the invention disclosed in the attached claims.

We claim:

1. A connector for connecting a twin wire, having a first conductor and a second conductor, to the electromagnetic field of a resonator, comprising:

an elongated rod-shaped center conductor, a first end of which is connected to said first conductor of said twin wire, and a generally tubular conductor, which surrounds said rod-shaped center conductor and is arranged coaxially with said rod-shaped center conductor and a first end of which is connected to said second conductor of said twin wire, said rod-shaped center conductor being longer than said generally tubular conductor so that one end of said rod-shaped center conductor projects from said generally tubular conductor, a movable part made of low-loss dielectric material or ferrimagnetic material, said part surrounding both said rod-shaped center conductor and said generally tubular conductor and being movable lengthwise of said rod-shaped center conductor so as to adjust the phase angle of a wave reflecting from said connector, to intensify adjustment of the phase angle of a wave reflecting from said connector, said connector further including a surrounding tubular metal sleeve connected to ground potential, said one end of said rod-shaped center conductor projecting from said metal sleeve.

2. The connector according to claim 1, wherein said projecting one end of said rod-shaped center conductor is connected to said generally tubular conductor by a conductor portion that forms an inductive loop.

3. The connector according to claim 1, wherein:

said moveable part is a cylindrical part that is made of a ceramic material or polytetrafluroethylene and through the center of which there extends a hole.

4. A connector for connecting a twin wire having a first conductor and a second conductor to the electromagnetic field of a resonator, comprising:

a first elongated rod-shaped center conductor, a first end of which is connected to said first conductor of said twin wire, a first generally tubular conductor surrounding said first rod-shaped center conductor, said first generally tubular conductor being arranged coaxially with said first center conductor and having a first end connected to said second conductor of said twin wire, said rod-shaped center conductor and a second end of said rod-shaped center conductor projecting from said generally tubular conductor;

a second rod-shaped center conductor;

a second generally tubular conductor surrounding said second rod-shaped center conductor, said second generally tubular conductor being arranged coaxially with said second rod-shaped center conductor;

a coaxial conductor connecting said first rod-shaped center conductor with said second rod-shaped center conductor and said first generally tubular conductor to said second generally tubular conductor;

a part made of low-loss dielectric material or ferrimagnetic material, said part surrounding said second rod-shaped center conductor and being moveable lengthwise of said second rod-shaped center conductor so as to adjust the phase angle of a wave reflecting from said connector.

5. A method for tuning a summing network of a base station which has at least a first and a second transmitter branch, each including a radio transmitter, and a filter with a first connector for receiving signals supplied by the radio transmitter and a second connector for forwarding filtering signals, and an antenna which is connected to the second connector of the filter for receiving filtered signals from the first and second transmitter branches, said method comprising the steps of:

providing said second connector of said filter in each of said first and second transmitter branches with a respective adjuster for adjusting a phase angle of a wave reflecting from said second connector, and tuning the summing network by adjusting said phase angle, using said respective adjuster, separately for said first and second transmitter branches.

6. A band-pass filter, comprising:

a resonator, a first connecting means for receiving signals to be filtered and for supplying said signals to the electromagnetic field of said resonator, and a second connecting means for receiving filtered signals from the electromagnetic field of said resonator and for forwarding said filtered signals, at least one of said first and second connecting means comprising adjusting means for adjusting the phase angle of a wave reflecting from the respective said connecting means, said second connecting means comprising a rod-shaped center conductor, a tubular conductor that surrounds said rod-shaped center conductor and is arranged coaxially with said rod-shaped center conductor, and a moveable part that is made of low-loss dielectric material or ferrimagnetic material and surrounds said rod-shaped center conductor and is movable lengthwise of said rod-shaped center conductor so as to adjust the phase angle of a wave reflecting from said second connecting means, said resonator comprises two blocks made of dielectric material, said resonance frequency adjusting means are arranged to move one of said dielectric blocks in relation to the other of said dielectric blocks, and said resonance frequency adjusting means and said phase angle adjusting means are connected to a common actuator which is arranged to move said moveable part and said one of said dielectric blocks in response to a control signal supplied to said common actuator.

7. The filter according to claim 6, further further comprising:

adjusting means for adjusting the resonance frequency of said resonator, and said resonance frequency adjusting means being connected to said phase angle adjusting means so as to adjust the phase angle of a wave reflecting from the respective said connecting means to correspond to the resonance frequency of said resonator.

* * * * *